US009058704B2

(12) United States Patent
Colburn

(10) Patent No.: US 9,058,704 B2
(45) Date of Patent: Jun. 16, 2015

(54) ELECTRONIC VEHICLE KEY

(76) Inventor: Craig Alexander Colburn, Longmeadow, MA (US)

( * ) Notice: Subject to any disclaimer, the term of this patent is extended or adjusted under 35 U.S.C. 154(b) by 257 days.

(21) Appl. No.: 13/602,701

(22) Filed: Sep. 4, 2012

(65) Prior Publication Data

US 2014/0062655 A1 Mar. 6, 2014

(51) Int. Cl.
*G07C 9/00* (2006.01)

(52) U.S. Cl.
CPC ..... *G07C 9/00309* (2013.01); *G07C 9/00182* (2013.01)

(58) Field of Classification Search
CPC ..... G07C 9/00309; G07C 9/00182
USPC ..... 340/426.16, 426.36, 5.6, 5.61, 5.64; 307/10.3, 10.5
See application file for complete search history.

(56) References Cited

U.S. PATENT DOCUMENTS 5,889,472 A 3/1999 Nagel et al.
6,943,666 B2 * 9/2005 Mooney et al. ..... 340/10.5
7,548,491 B2 6/2009 Macfarlane
2003/0231550 A1 * 12/2003 Macfarlane ..... 367/198
2005/0099275 A1 * 5/2005 Kamdar et al. ..... 340/426.18
2006/0049922 A1 * 3/2006 Kolpasky et al. ..... 340/426.13
2007/0035277 A1 * 2/2007 Hsieh ..... 320/128
2007/0149254 A1 * 6/2007 Carrero et al. ..... 455/573
2008/0018303 A1 * 1/2008 Scheucher ..... 320/128
2008/0117079 A1 * 5/2008 Hassan ..... 340/901
2008/0150685 A1 6/2008 Desai et al.
2009/0160607 A1 6/2009 Edwards et al.
2010/0093429 A1 * 4/2010 Mattice et al. ..... 463/25
2011/0115605 A1 * 5/2011 Dimig et al. ..... 340/5.61
2012/0116605 A1 5/2012 Seymour et al.
2013/0311836 A1 * 11/2013 Hurst et al. ..... 714/48

* cited by examiner

*Primary Examiner* — Andrew Bee
(74) *Attorney, Agent, or Firm* — Cantor Colburn LLP

(57) ABSTRACT

An electronic vehicle key is provided. The electronic vehicle key includes a battery and a controller receptive to electrical power from the battery. The electronic vehicle key further includes a connecting circuit receptive to electrical power from a vehicle. The electronic vehicle key still further includes an interface circuit that is configured to provide an electrical connection between the connecting circuit and the controller, at least when the battery is ineffective for electrically powering the controller.

28 Claims, 5 Drawing Sheets

ELECTRONIC VEHICLE KEY

BACKGROUND OF THE INVENTION

The subject matter disclosed herein relates to an electronic key for a vehicle and in particular to an electronic key that may operate the vehicle with a discharged or nonfunctioning key battery.

Vehicles often have security systems to prevent inadvertent or unauthorized use of the vehicle. Traditionally, the security system was accomplished via a mechanical key. The vehicles doors and activation systems had a corresponding mechanical lock that required the key to be inserted and rotated. When the key was turned in an ignition lock, a relay closes to complete an electrical starting circuit that activates the vehicle.

For convenience of users, door keys have, in some applications, been eliminated in favor of wireless remotes which allow the operator to unlock the door prior to arrival at the vehicle. These wireless remotes typically also function as a keychain which keeps the mechanical ignition/activation key coupled with the wireless remote. Other electronic keys have been developed which replace the mechanical key for both the door lock and the ignition/activation lock. These electronic keys typically have a wireless transponder such as a radio frequency identification device (RFID) that the vehicle detects and unlocks the door when the operator arrives. Similarly, the vehicle detects when the operator is in the vehicle and enables the vehicle to be started. Some electronic keys must be inserted into a slot in the dashboard before the vehicle will activate or start the engine.

Both the wireless remote and the electronic key have a small battery that allows the device to operate. In some of these devices, the housing of the key is sealed and the battery is not replaceable. The sealing of the key housing provides advantages by increasing security and preventing contaminants, such as water for example, from damaging electronic components. Unfortunately, when the battery level is below a threshold, the electronic key will not communicate with the vehicle and the operator will not be able to activate or start the engine. Replacement of the battery usually requires ordering a new electronic key from the manufacturer, which may take days or weeks to arrive. It should be appreciated that the failure of the electronic key may result in the operator being stranded in a remote or dangerous area without any means of starting their vehicle.

Accordingly, while existing electronic keys are suitable for their intended purposes the need for improvement remains, particularly in providing an electronic key that may be operated with a nonfunctioning battery or one at a low energy state.

BRIEF DESCRIPTION OF THE INVENTION

According to one embodiment of the invention, an electronic vehicle key includes a battery, a controller receptive to electrical power from the battery, a connecting circuit receptive to electrical power from a vehicle, and an interface circuit configured to provide an electrical connection between the connecting circuit and the controller at least when the battery is ineffective for electrically powering the controller.

According to another embodiment of the invention, a system for activating a vehicle includes a receptacle disposed within the vehicle, and a first connecting circuit disposed at the receptacle. The first connecting circuit is in communication with electrical power of the vehicle. The system further includes a key having a housing configured to be received at the receptacle. A battery is disposed within the housing. A controller is disposed within the housing. The controller is receptive to electrical power from the battery. A second connecting circuit is disposed at the housing. The second connecting circuit is in communication with the first connecting circuit when the housing is received at the receptacle, whereby electrical power from the vehicle at the first connecting circuit is communicated to the second connecting circuit. Further, an interface circuit is disposed within the housing. The interface circuit is configured to provide an electrical connection between the second connecting circuit and the controller at least when the battery is ineffective for electrically powering the controller.

According to another embodiment of the invention, a method of activating a vehicle for operation, includes determining a battery energy level of a battery in an electronic key, transmitting electrical power from the vehicle to the electronic key in response to the determining the battery energy level, transmitting a wireless signal from the electronic key, receiving the wireless signal at the vehicle, and activating the vehicle in response to receiving the wireless signal.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Vehicles often utilize security systems to prevent unintended starting of the vehicle as well as unauthorized use. Electronic keys that transmit a wireless signal to the vehicle are a convenient device that allows the operator both access to the vehicle and activation of the vehicle power source. Embodiments of the present invention provide an electronic key that is capable of activating the vehicle when the key battery is nonfunctioning or at a low energy state. Other embodiments of the invention provide advantages in allowing recharging of the electronic key battery to maintain a desired energy state.

Figure 1:
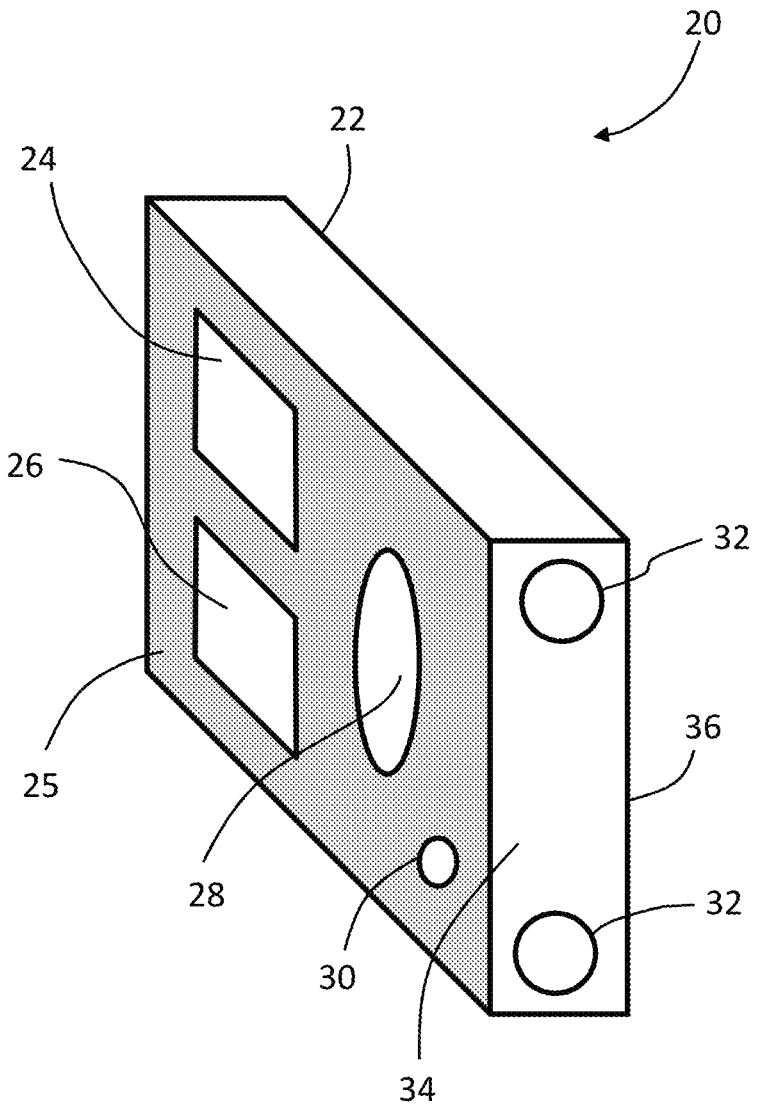
FIG. 1 is a perspective view of an electronic key in accordance with an embodiment of the invention.

An electronic key 20 is shown in FIG. 1 that may be used with vehicles to unlock the vehicle door and also activate other vehicle systems such as the engine and the electronic controls for example. The key 20 has a housing 22, which may have at least one button 24 on one side 25 for performing a function, such as unlocking the vehicle doors, when actuated. In the exemplary embodiment, the housing 22 may have a plurality of buttons 24, 26, 28 that may provide additional functionality to the user. For example, actuation of the buttons may result in the opening of a trunk, starting of the car, activating an alarm, and locking doors. In one embodiment, the housing may have an indicator 30, such as a light emitting diode (LED) for example, that provides a notification to the operator when there is an issue with the key 20, such as the battery energy state being ineffective for performing a desired function. The housing 22 and buttons 24, 26, 28 may be made from a suitable plastic material, such as but not limited to polycarbonate, polypropylene, and high-density polyethylene for example.

Figure 3:
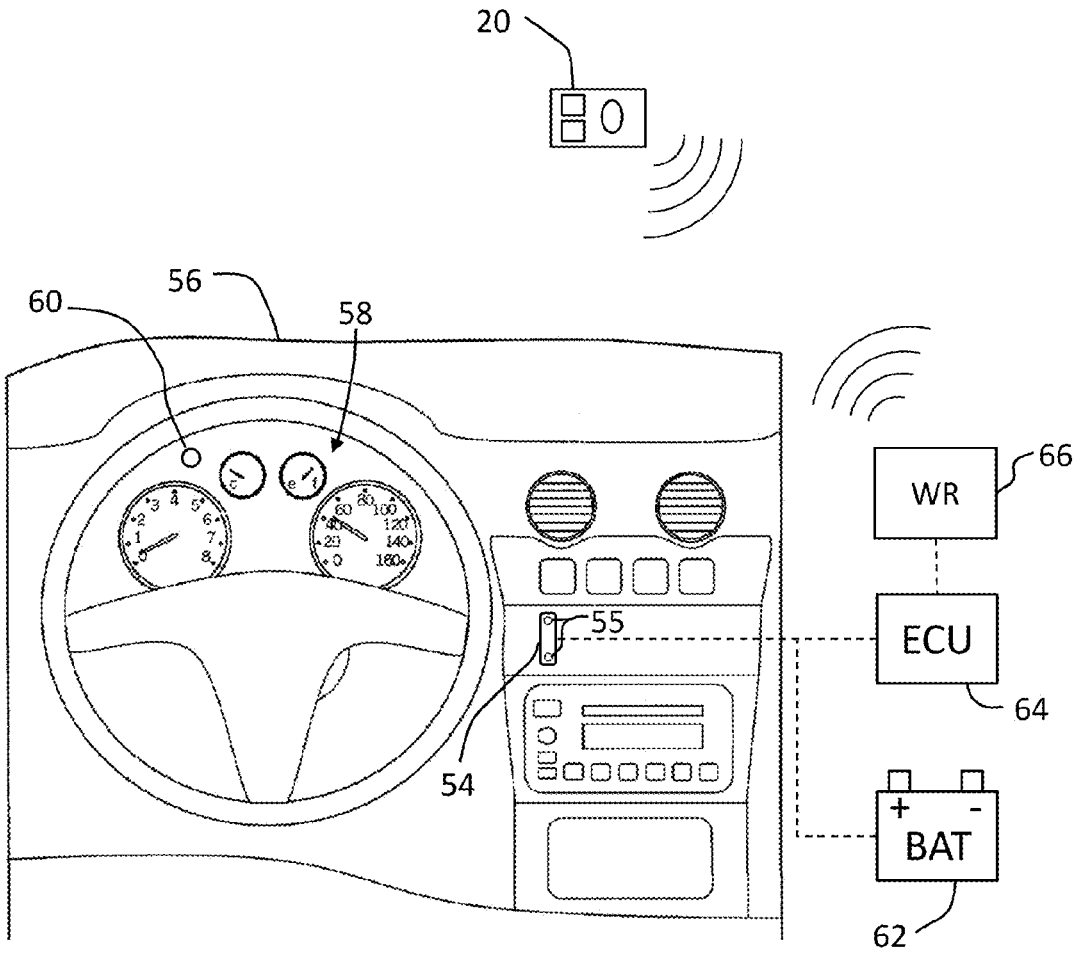
FIG. 3 is a partial schematic view of a vehicle system that uses the electronic key of FIG. 1; and, FIG. 4 is a flow chart for activating a vehicle with an electronic key in accordance with an embodiment of the invention.

The key 20 further includes a connecting circuit, which in the present exemplary embodiment is a pair of contacts 32. As will be discussed in more detail below, the contacts 32 are disposed in the housing 22 and at least partially exposed to the external environment to allow the contacts 32 to be electrically coupled to a receptacle 54 (FIG. 3) to provide electrical power to the key 20. Further, it should be appreciated that while embodiments herein describe the pair of contacts 32 as being disposed on an end 34 of the housing 22, this is for exemplary purposes and the claimed invention should not be so limited. In other embodiments, the contacts 32 may be disposed along an edge, a side 36 opposite the buttons or on the side 25 of the buttons. Further, the pair of contacts 32 may be any suitable shape, such as round, square, or rectangular for example. Further, the key 20 may have additional contacts that allow for other functionality, such as data communication for example, when the key 20 is received in a corresponding receptacle for example.

Figure 2A:
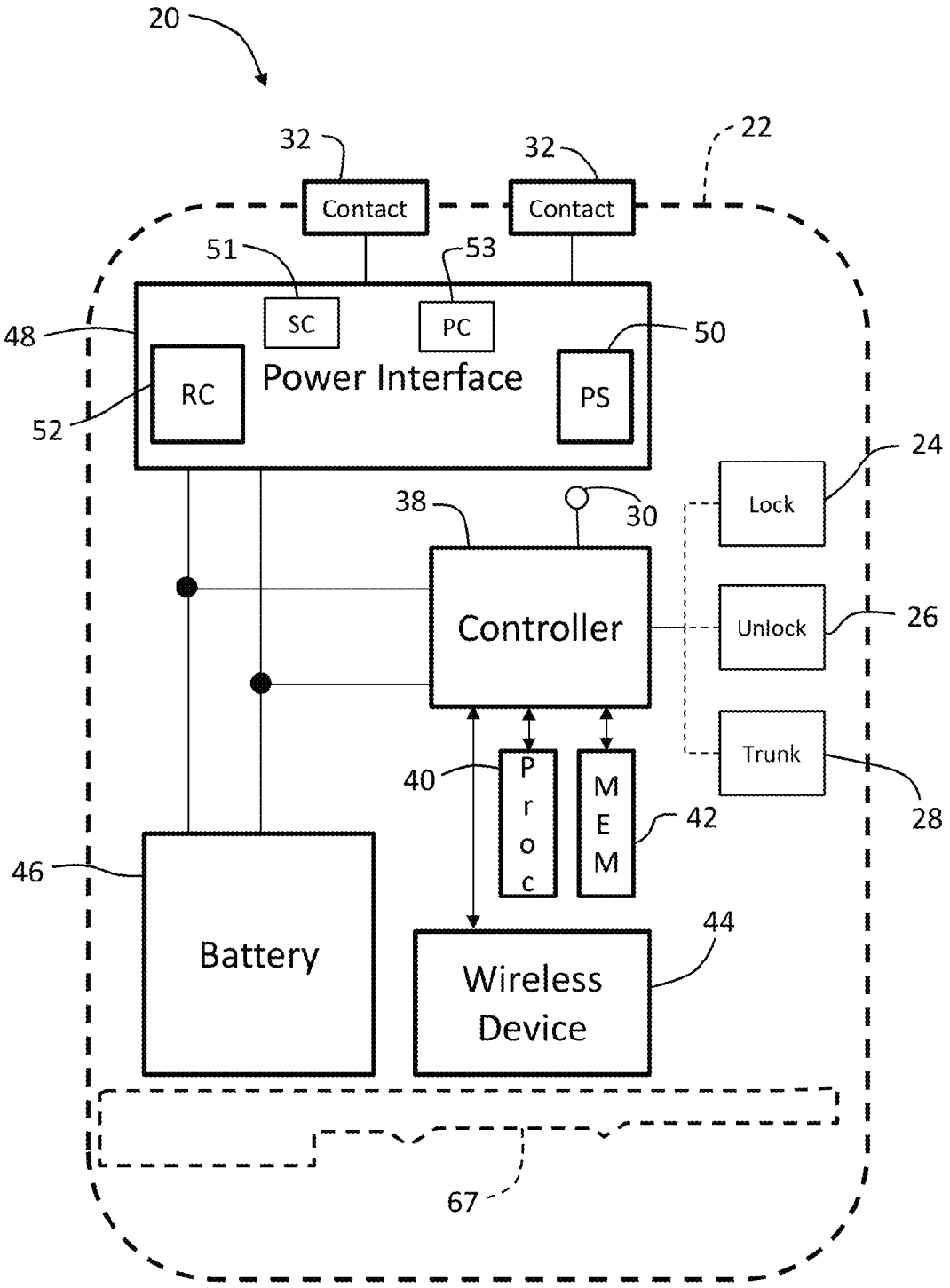
FIGS. 2A and 2B are schematic views of the electronic key in accordance with embodiments of the invention.

The key 20 further includes several components shown in FIGS. 2A and B that are arranged within the housing 22. A controller 38 is arranged within the housing 22. In the exemplary embodiment, the controller 38 includes a processor 40 that provides the desired control functionality and controls the operation of the key 20. The controller 38 is a suitable electronic device capable of accepting data and instructions, executing instructions to process data and transmitting a resulting signal. The controller 38 may accept instructions through the buttons 24, 26, 28 or through other means, such as radiated wavelength and electronic or electrical transfer. The controller 38 may be but is not limited to a microprocessor, a complex instruction set computer, an application specific integrated circuit (ASIC), a reduced instruction set computer or the like.

The controller 38 is capable of converting analog voltage or current levels into digital signals. The controller 38 uses the digital signals for processing and to act as input to various processes for controlling the key 20. The controller 38 is operably coupled with one or more components of the key 20 such as memory 42 and a wireless device 44. The wireless device 44 may be a transceiver (e.g. capable of receiving and transmitting signals), that actively transmits and receives signals, an active transmitter only, or may be a passive device that transmits a signal in response to an external magnetic field that induces an electrical current in the device.

The wireless device 44 may be, but is not limited to: an RFID device, a Bluetooth device, a radio-frequency device, or an IEEE 802.11 compliant device for example. In one embodiment, the wireless device 44 is a rolling code type transmitter that prevents unauthorized persons from acquiring the codes for opening or activating the vehicle.

Figure 4:
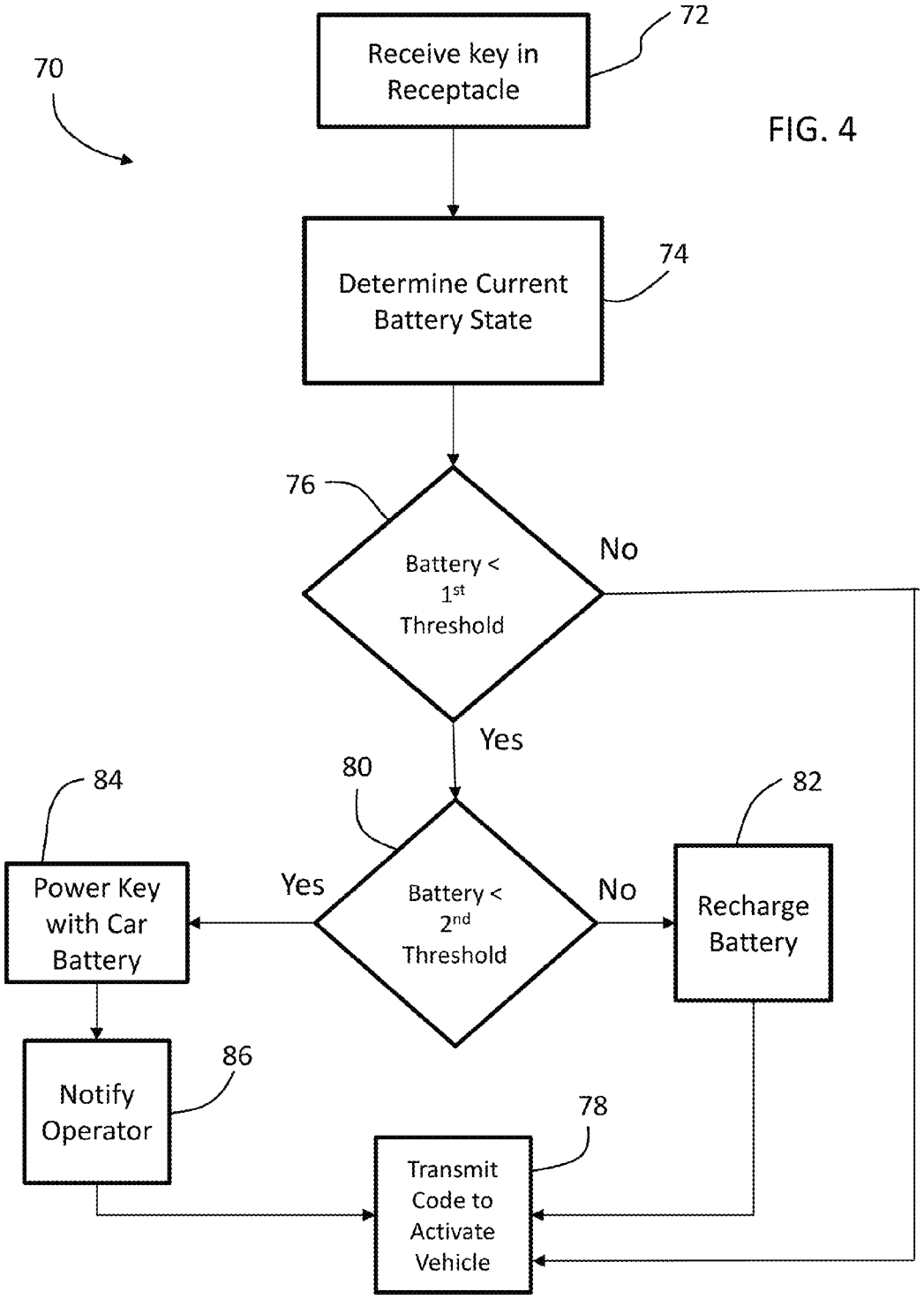

Controller 38 includes operation control methods embodied in application code, such as that shown in FIG. 4 for example. These methods are embodied in computer instructions written to be executed by processor 40, typically in the form of software. The software can be encoded in any suitable computer programming language, such as C++ for example.

The controller 38 and wireless device 44 are powered by a battery 46 arranged within the housing 22. The battery 46 provides electrical power needed by the key 20 during operation. The battery 46 may be any suitable energy storage device capable of storing an electrical charge and discharging to an electrical circuit such as a dry-cell type battery for example. In one embodiment, the battery 46 may be a re-chargeable storage device, such as but not limited to a lithium-ion battery or a nickel-cadmium battery for example.

Figure 2B:
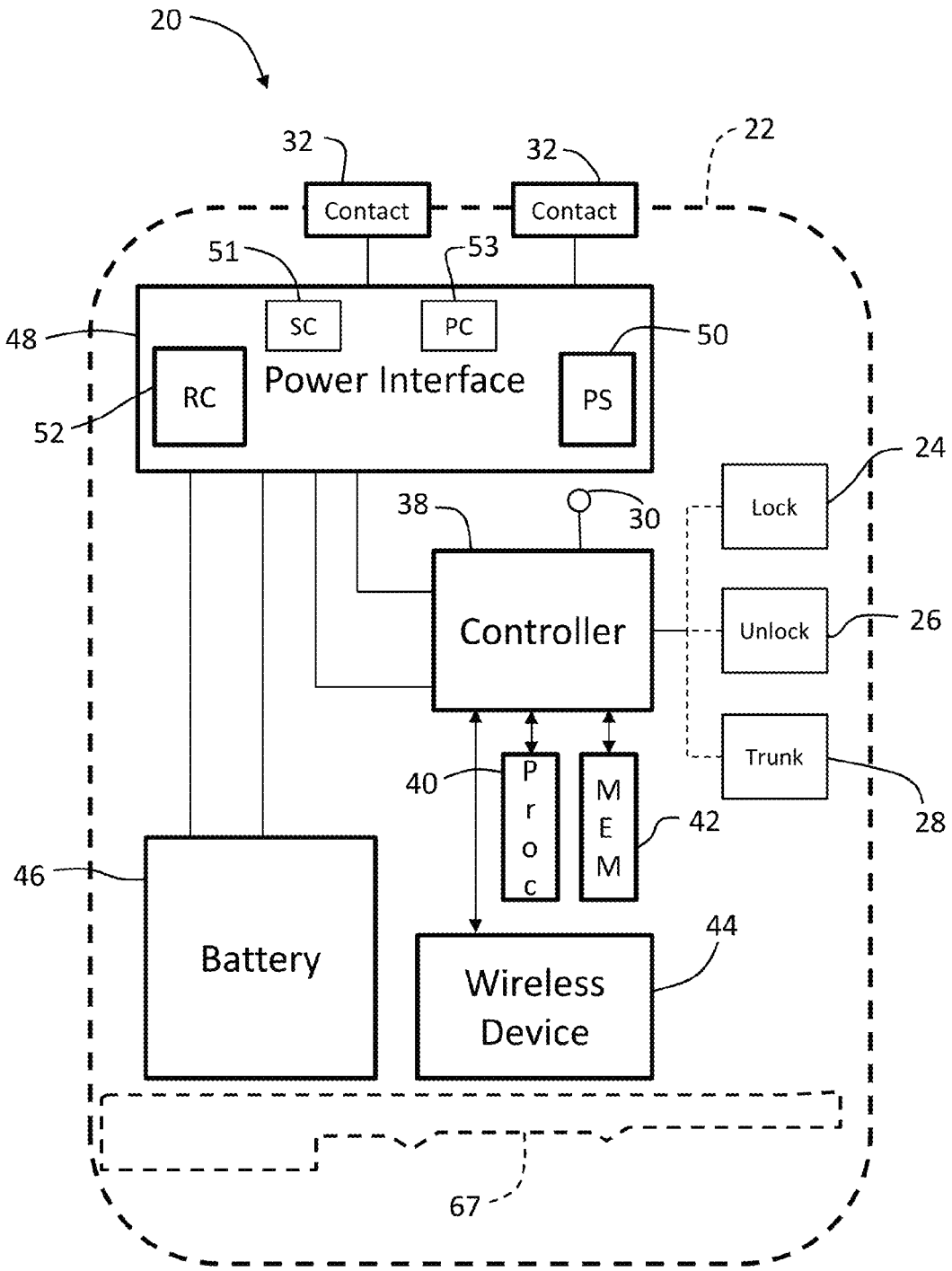

A interface circuit 48 is electrically coupled between the contacts 32 and the controller 38. Power to other electrical components of the key 20 can be sourced from the controller 38 or the interface circuit 48. In one embodiment the interface circuit 48 includes a power sensing circuit 50 that senses the power level of the battery 46. Alternatively the controller 38 can be configured to sense the power level of the battery 46. Such power sensing circuitry is well known for sensing voltage and current levels provided by a battery. In the case where the battery 46 is of the type that emulates an open circuit condition in a low power state, the battery 46 can be electrically connected to both the interface circuit 48 and the controller 38, as is shown in FIG. 2A. When the sensed power level is below a threshold, a switch circuit 51 of the interface circuit 48 switches or changes state to allow electrical power received at the contacts 32 to flow into the electronic key 20. However, in the case where the battery 46 is of the type that emulates a closed or short circuit condition in a low power state, the battery 46 is electrically connected to the interface circuit 48 and not directly to the controller 38, as shown in FIG. 2B. In the embodiment shown in FIG. 2B, the battery power is sensed at the power sensing circuit 50 of the interface circuit 48. When the sensed electrical power level is at a level where the key 20 is ineffective, the switch circuit 51 of the interface circuit 48 switches from electrical power received from the battery 46 to electrical power received at the contacts 32. It should be appreciated that a power level that is ineffective is one where the key 20 does not have sufficient electrical power to carry out the intended functions (e.g. activate the vehicle). The interface circuit 48 may include a power conditioning circuit 53 if the electrical power provided to the contacts 32 needs to be conditioned to power the electrical components of the key 20. Such power conditioning is well known and simply converts the electrical power signals to desired voltage levels. However, if the electrical power provided to the contacts 32 does not need to be conditioned to power the electrical components of the key 20, then the power conditioning circuit 53 can be avoided.

While the switching circuit 51 has been described as an electronic switch, it is within the scope of the invention that the switching circuit 51 is a mechanical switch that would electrically connect the contacts 32 to components (e.g., the controller 38) of the key 20. The mechanical switch could be a simple slide-type switch on the key 20 that is manually actuated by the operator when the key 20 does not function. In such an exemplary embodiment, the use of the sensing circuit could be avoided.

In one embodiment the interface circuit 48 includes a recharging circuit 52 that recharges the battery 46. Such recharging circuitry is well known for sensing voltage and current levels provided by a battery. In such embodiments the battery 46 is rechargeable battery. In this embodiment, the recharging circuit of the interface circuit 48 receives power from the contacts 32 and then provides recharging power to the battery 46. Alternatively the controller 38 can be configured to recharge the battery 46 from power received at the contacts 32 through the interface circuit 48 The interface circuit 48 may be configured to simultaneously power the key 20 and re-charge the battery 46. In still other embodiments, the interface circuit 48 may be configured to only power the controller 38 when the battery 46 is below a threshold or non-functioning. In yet still other embodiments, the interface circuit 48 may be configured to only re-charge the battery 46.

In one embodiment, the connecting circuit may be an inductive circuit that allows electrical power to be transferred from the vehicle to the key 20. An inductive circuit is well known as a means for transferring electrical power through magnetic fields without a conductive connection.

The housing 22 is sized and shaped to be received within a receptacle 54 (FIG. 3) in the vehicle. The receptacle 54 may be positioned in a convenient place for the operator, such as the dashboard 56 shown in FIG. 3 for example. In other embodiments, the receptacle 54 may be placed within a compartment, such as a center console, an arm rest or a glove compartment for example. The receptacle 54 includes another connecting circuit, which in the present exemplary embodiment is a pair of contacts 55 that are configured to engage the pair of contacts 32 when the key 20 is inserted into the receptacle 54. However, in the embodiment described herein where the connecting circuit of the key 20 is an inductive circuit; the connecting circuit at the receptacle 54 would also be an inductive circuit. The pair of contacts 32 may have a biasing or spring loaded feature to ensure electrical connection when the key is inserted. Such biasing features are well known in electronic devices. In one embodiment, the vehicle has an instrument panel 58 that includes an indicator 60 that may be used to alert the operator that there is an issue with the key battery 46, such as needing to be recharged or replaced for example.

The receptacle 54 is electrically connected to the vehicle battery 62. It should be appreciated that there may be one or more electrical components, such as relays, transformers and fuses for example, may be coupled between the vehicle battery 62 and the receptacle 54. This connection allows electrical power from the battery 62 to be transferred to the key 20 to recharge the battery 46, power the controller 38 or a combination thereof. It should be appreciated that in embodiments where the contacts 32 form an inductive circuit, the receptacle 54 may be a recessed area or other space (e.g. a drawer, an arm rest or center console compartment) which the operator places the key 20.

The receptacle 54 may further be connected for communication to the engine control unit 64 (ECU). Communication between the receptacle 54 and the ECU 64 may be direct, meaning that the signals, such as an activation enable signal or a battery low signal for example, may be passed directly from the key 20 to the ECU 64. In another embodiment, the connection may be indirect, meaning that the ECU 64 may infer that there is an issue with the battery 46 since the battery 62 is providing electrical power to the key 20. The vehicle may further include a wireless device 66 that is configured to receive signals from the key 20. In one embodiment, the key 20 and the wireless device 66 and key 20 are configured for bi-directional asynchronous communication. In one embodiment, the communication between the key 20 and the ECU 64 is via the contacts 32, 55 when the key 20 is inserted in the receptacle 54. In a further embodiment, the wireless device 66 and the key 20 may communicate using a suitable communications protocol, such as that defined by the IEEE 802.11 standard or the Bluetooth standard for example.

With the electronic key 20 inserted in the receptacle 54, the electronic key 20 has electrical power even with a low battery state or a defective battery. With the electronic key 20 energized, the vehicle may be operated. It should be appreciated that the operator may still desire to replace the electronic key 20 since the wireless door unlock functionality may not function. However, until the operator is able to obtain a replacement, the operator would still be able to unlock the vehicle doors with low or defective battery using a slide out mechanical key 67, such as are found with electronic keys. Thus, the vehicle is always available and the probability of the operator becoming stranded in a remote or dangerous location due to an inoperable electronic key is reduced or eliminated.

Referring now to FIG. 4, a method 70 is shown of the operation of an electronic key 20 having a rechargeable battery. The method 70 starts with receiving 72 the key 20 in the receptacle 54. The method 70 then determines 74 the current energy state of the battery 46. In other embodiments, the state of the battery may be checked on a periodic or aperiodic basis even when the key 20 is not in the receptacle 54. In these embodiments, the controller 38 may activate the indicator 30 when the battery energy state is below a desired threshold. With the energy state determined, the method 70 then proceeds to compare 76 the battery energy state to determine if it is less than a first threshold. If the energy state is above the threshold, then the energy state is more than adequate for operation and does not need to be recharged. Some types of rechargeable batteries have operating parameters that determine when to recharge the battery for enhanced battery life. For example, some types of batteries have a memory affect which results in a loss of capacity if they are recharged with a high level of energy remaining. The first threshold may represent an energy state of 25% of the battery capacity for example.

If the comparison of the battery energy state with the first threshold is a negative, the method 70 proceeds to transmit 78 the activation code to the vehicle. If the comparison results in a positive, the method 70 proceeds to compare 80 the battery energy level to determine if it is less than second threshold. This second threshold represents an energy state below which the key 20 may not operate correctly and may be nonfunctional. If this comparison 80 has a negative result, the key 20 proceeds to recharge 82 the battery 46 and transmits 78 the activation code.

If the comparison with the second threshold results in a positive, meaning that the battery 46 is ineffective or not sufficient for operation, then the method 70 then configures the interface circuit 48 to power 84 the controller 38 using electrical power from the vehicle that is received via receptacle 54. In one embodiment, the electrical power is supplied directly to the controller 38. In another embodiment, the electrical power to operate the controller 38 flows through the battery 46. In one embodiment, when the key 20 (having a nonfunctioning battery) is provided with sufficient electrical power to operate, the operator is notified 86 via the key indicator 30, an audio signal, the dashboard indicator 60 or a combination thereof before proceeding to transmit 78 the activation code to the vehicle.

Embodiments of the present invention provide advantages in allowing an electronic key to activate a vehicle when its battery is ineffective, low or nonfunctioning. Still further embodiments of the present invention provide advantages in allowing a battery in an electronic key to be recharged by a vehicle during operation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electronic vehicle key comprising:

a battery;

a controller receptive to electrical power from the battery, the controller having a processor that is responsive to executable computer instructions for transmitting a signal to a vehicle to enable activation of a vehicle;

a connecting circuit receptive to electrical power from the vehicle; and an interface circuit configured to provide switched electrical connection between the battery and the controller in a first mode when the battery is effective for electrically powering the controller and the electronic vehicle key is directly coupled to the connecting circuit, and between the connecting circuit and the controller in a second mode when the battery is ineffective for electrically powering the controller and the electronic vehicle key is directly coupled to the connecting circuit;

an indicator electrically coupled to the controller, wherein the controller is configured to measure the energy state of the battery on an aperiodic basis when the key is not coupled to the vehicle, the controller further being configured to activate the indicator when the energy state of the battery is below a threshold.

2. The electronic vehicle key of claim 1 wherein the interface circuit is configured to provide an electrical connection between the controller and the battery.

3. The electronic vehicle key of claim 1 wherein the controller is electrically connected to the battery.

4. The electronic vehicle key of claim 1 wherein the interface circuit comprises a switching circuit.

5. The electronic vehicle key of claim 1 wherein the interface circuit comprises a mechanical switch.

6. The electronic vehicle key of claim 1 further comprising a recharging circuit electrically coupled to the battery for recharging the battery.

7. The electronic vehicle key of claim 1 further comprising a sensing circuit electrically coupled to the battery for sensing power at the battery.

8. The electronic vehicle key of claim 1 further comprising a power conditioning circuit electrically coupled to the connecting circuit for conditioning electrical power from the vehicle.

9. The electronic vehicle key of claim 1 wherein the connecting circuit comprises a pair of contacts that is at least partially exposed external of the electronic vehicle key.

10. The electronic vehicle key of claim 1 wherein the connecting circuit comprises an inductive circuit.

11. A system for activating a vehicle comprising:

a receptacle disposed within the vehicle;

a first connecting circuit disposed at the receptacle, the first connecting circuit in communication with electrical power of the vehicle; and a key comprising, a housing configured to be received at the receptacle, a battery disposed within the housing, a controller disposed within the housing, the controller receptive to electrical power from the battery, the controller having a processor that is responsive to executable computer instructions for transmitting a signal to a vehicle to enable activation of the vehicle, a second connecting circuit disposed at the housing, the second connecting circuit in communication with the first connecting circuit when the housing is received at the receptacle, whereby electrical power from the vehicle at the first connecting circuit is communicated to the second connecting circuit, an interface circuit disposed within the housing, the interface circuit configured to provide a switched electrical connection between the battery and the controller in a first mode when the electronic vehicle key is directly coupled to the connecting circuit and the battery is effective for electrically powering the controller, and between the second connecting circuit and the controller in a second mode when the battery is ineffective for electrically powering the controller and the electronic vehicle key is directly coupled to the second connecting circuit; and an indicator electrically coupled to the controller, wherein the controller is configured to measure the energy state of the battery on an aperiodic basis when the key is not directly coupled to the receptacle, the controller further being configured to activate the indicator when the energy state of the battery is below a threshold.

12. The system of claim 11 further comprising:

an engine control unit disposed within the vehicle;

a wireless receiver disposed within the vehicle and configured to communicate with the engine control unit; and, a wireless transmitter disposed within the housing, the wireless transmitter configured for communication with the wireless receiver, wherein the engine control unit enables an activation of the vehicle in response to the wireless receiver receiving a signal from the wireless transmitter.

13. The system of claim 11 wherein the receptacle is disposed in a dashboard of the vehicle.

14. The system of claim 11 wherein the interface circuit is configured to provide an electrical connection between the controller and the battery.

15. The system of claim 11 wherein the controller is electrically connected to the battery.

16. The system of claim 11 wherein the interface circuit comprises a switching circuit.

17. The system of claim 11 wherein the interface circuit comprises a mechanical switch.

18. The system of claim 11 further comprising a recharging circuit electrically coupled to the battery for recharging the battery.

19. The system of claim 11 further comprising a sensing circuit electrically coupled to the battery for sensing power at the battery.

20. The system of claim 11 further comprising a power conditioning circuit electrically coupled to the second connecting circuit for conditioning electrical power from the vehicle.

21. The system of claim 11 further comprising a power conditioning circuit electrically coupled to the first connecting circuit for conditioning electrical power of the vehicle.

22. The system of claim 11 wherein the second connecting circuit comprises a pair of contacts that is at least partially exposed external of the housing.

23. The system of claim 11 wherein the first connecting circuit comprises a pair of contacts configured to be accessible at the receptacle.

24. A method of activating a vehicle for operation, the method comprising:

determining a battery energy level of a battery in an electronic key on an aperiodic basis when the key is not coupled to a receptacle in the vehicle;

activating an indicator on the electronic key when the energy level of the battery is below a threshold;

transmitting electrical power from the vehicle to the electronic key in response to the determining the battery energy level is below the threshold and the electronic key is directly coupled to the receptacle;

transmitting electrical power from the vehicle to the battery in a first mode when the electronic key is directly connected to the receptacle and the battery is effective for electrically powering a controller in the electronic key, and between the vehicle and the controller when the battery is ineffective for powering the controller and the electronic key is directly coupled to the receptacle in response to the determining the battery energy level is below the threshold;

receiving the wireless signal at the vehicle; and activating the vehicle in response to receiving the wireless signal.

25. The method of claim 24 further comprising recharging the battery with electrical power from the vehicle.

26. The method of claim 24 further comprising indicating the battery energy level.

27. The method of claim 24 wherein the transmitting electrical power comprises conductive transmission of electrical power.

28. The method of claim 24 wherein the transmitting electrical power comprises inductive transmission of electrical power.

* * * * *